US010499724B2

(12) United States Patent
Hyson

(10) Patent No.: US 10,499,724 B2
(45) Date of Patent: Dec. 10, 2019

(54) DRYWALL KNIFE HOLSTER

(71) Applicant: Stephen L. Hyson, Springville, UT (US)

(72) Inventor: Stephen L. Hyson, Springville, UT (US)

( * ) Notice: Subject to any disclaimer, the term of this patent is extended or adjusted under 35 U.S.C. 154(b) by 26 days.

(21) Appl. No.: 15/891,045

(22) Filed: Feb. 7, 2018

(65) Prior Publication Data

US 2019/0239628 A1 Aug. 8, 2019

(51) Int. Cl.
*A45F 5/02* (2006.01)
*E04F 21/165* (2006.01)

(52) U.S. Cl.
CPC ..... *A45F 5/021* (2013.01); *A45F 2200/0575* (2013.01); *E04F 21/1652* (2013.01)

(58) Field of Classification Search
CPC ..... A45F 5/021
USPC ..... 224/677, 268, 269, 197
See application file for complete search history.

(56) References Cited

U.S. PATENT DOCUMENTS 1,270,158 A * 6/1918 Hill ..... A45F 5/02 224/666
1,281,656 A * 10/1918 Raschick ..... A45F 5/02 24/3.12
1,618,573 A * 2/1927 Cole ..... A45C 1/04 206/37.6
2,320,067 A * 5/1943 Caughren ..... A01M 31/006 224/248
4,746,042 A * 5/1988 King ..... A45F 5/02 224/148.2
5,176,302 A * 1/1993 Smith ..... A45F 5/02 224/667
D338,048 S * 8/1993 Finley ..... D21/796
5,388,740 A * 2/1995 Garland ..... A45F 5/02 224/242
5,619,774 A * 4/1997 Perry ..... A45F 5/02 24/3.12
6,199,733 B1 * 3/2001 Reynolds, III ..... A45F 5/02 224/255
D489,175 S * 5/2004 Gaita ..... D3/215
6,742,685 B2 * 6/2004 Williams ..... A45F 5/02 224/197
D517,323 S * 3/2006 Raimondo ..... D3/328
(Continued)

OTHER PUBLICATIONS

Stephen L. Hyson, photograph taken on Oct. 28, 2016 of Stephen L. Hyson wearing a drywall knife holster, one page, unpublished.

*Primary Examiner* — Nathan J Newhouse
*Assistant Examiner* — Lester L Vanterpool

(57) ABSTRACT

A drywall knife holster includes a belt hook, a back member and a knife holder. The back member couples with the belt hook. The knife holder couples with the back member through an upwardly facing U-bend that biases a pinch region of the knife holder toward the back member. Inserting a drywall knife blade between the knife holder and the back member, and seating a leading edge of the drywall knife blade within the U-bend, causes the pinch region of the knife holder to urge a handle of the drywall knife into contact with the back member. The back member and the knife holder may form a holster portion that couples with the belt hook through a swiveling connector. The holster may continue past the pinch region to form a second drywall knife holder and/or a loop member to accommodate a different tool.

18 Claims, 5 Drawing Sheets

(56) References Cited

U.S. PATENT DOCUMENTS

| | | | | |
|---|---|---|---|---|
| 9,010,868 | B1 * | 4/2015 | Hashman | B60R 22/18 24/129 R |
| 9,463,662 | B1 * | 10/2016 | Sotolongo | B44D 3/126 |
| 10,040,605 | B1 * | 8/2018 | Popier | B65D 25/22 |
| 2002/0185509 | A1 * | 12/2002 | Wichman | A45F 5/00 224/677 |
| 2003/0230615 | A1 * | 12/2003 | Jones | A45F 5/00 224/677 |
| 2004/0040991 | A1 * | 3/2004 | McCoy | A45F 5/00 224/251 |
| 2005/0045685 | A1 * | 3/2005 | Sesto | A45F 5/02 224/587 |
| 2006/0237508 | A1 * | 10/2006 | Kaplan | A45C 1/04 224/674 |
| 2008/0083798 | A1 * | 4/2008 | Broadwell | A45F 5/02 224/269 |
| 2012/0104057 | A1 * | 5/2012 | Gerrior | A45F 5/021 224/183 |
| 2014/0305976 | A1 * | 10/2014 | Stallworth | A45F 5/021 224/269 |

* cited by examiner

DRYWALL KNIFE HOLSTER

BACKGROUND

Drywall installation generally involves securing wallboard panels in place, and applying and smoothing a joint compound (often called drywall "mud") to conceal fasteners, tape, joints between adjacent wallboard panels, minor wallboard damage and the like. Drywall installers (referred to herein as "drywallers") apply the mud in a wet state and use a drywall "knife" to smooth it while still wet. The mud dries, leaving a smooth wall finish for painting or wallpapering. Sometimes multiple applications of mud are required, a final coat possibly being a "skim coat" that covers the wallboard and previous applications of mud, to minimize any visual differences between otherwise bare wallboard, and mudded areas. The drywaller applying the mud generally handles at least a drywall knife and a mud pan at most times, and may also handle other tools such as hammers, screwdrivers and the like occasionally to address minor issues such as nails or screws that are not completely seated.

SUMMARY

In an embodiment, a drywall knife holster includes a belt hook, a back member and a knife holder formed of a material. The back member couples with the belt hook through a downwardly facing U-bend formed of the material. The knife holder couples with the back member through an upwardly facing U-bend, and the upwardly facing U-bend biases a pinch region of the knife holder toward the back member. Inserting a drywall knife blade between the knife holder and the back member, and seating a leading edge of the drywall knife blade within the upwardly facing U-bend, causes the pinch region of the knife holder to urge a handle of the drywall knife into contact with the back member.

In an embodiment, a drywall knife holster includes a belt hook portion formed of a first material and a holster portion formed of a second material. The holster portion includes a back member formed of the second material, and a knife holder formed of the second material. The knife holder couples with the back member through an upwardly facing U-bend, and the upwardly facing U-bend biases a pinch region of the knife holder toward the back member. Inserting a drywall knife blade between the knife holder and the back member, and seating a leading edge of the drywall knife blade within the upwardly facing U-bend, causes the pinch region of the knife holder to urge a handle of the drywall knife into contact with the back member. The holster portion couples with the belt hook portion through a swiveling connector.

In an embodiment, a drywall knife holster includes a belt hook, a back member and a knife holder formed of a material, and a continuation of the material. The back member couples with the belt hook through a downwardly facing U-bend of the material. The knife holder couples with the back member through an upwardly facing U-bend of the material, and the upwardly facing U-bend biases a pinch region of the knife holder toward the back member. Inserting a drywall knife blade between the knife holder and the back member, and seating a leading edge of the drywall knife blade within the upwardly facing U-bend, causes the pinch region of the knife holder to urge a handle of the drywall knife into contact with the back member. The continuation of the material forms at least one of a second knife holder and a loop member that accommodates a tool other than a drywall knife.

BRIEF DESCRIPTION OF THE DRAWINGS

The present disclosure is described in conjunction with the appended figures.

DETAILED DESCRIPTION

Holsters that can conveniently hold one or more drywall knives and/or other tools ready for use by a drywaller are disclosed herein. Advantages provided by embodiments include providing a convenient way to store the drywall knife, while also providing easy access for the drywaller to retrieve the drywall knife for use. Optional features include apertures that allow loose drywall mud to escape from the holster, provisions to store multiple tools, and a mechanism that allows a portion of the holster to swing freely when a user of the holster moves to a leaning position.

Figure 1A:
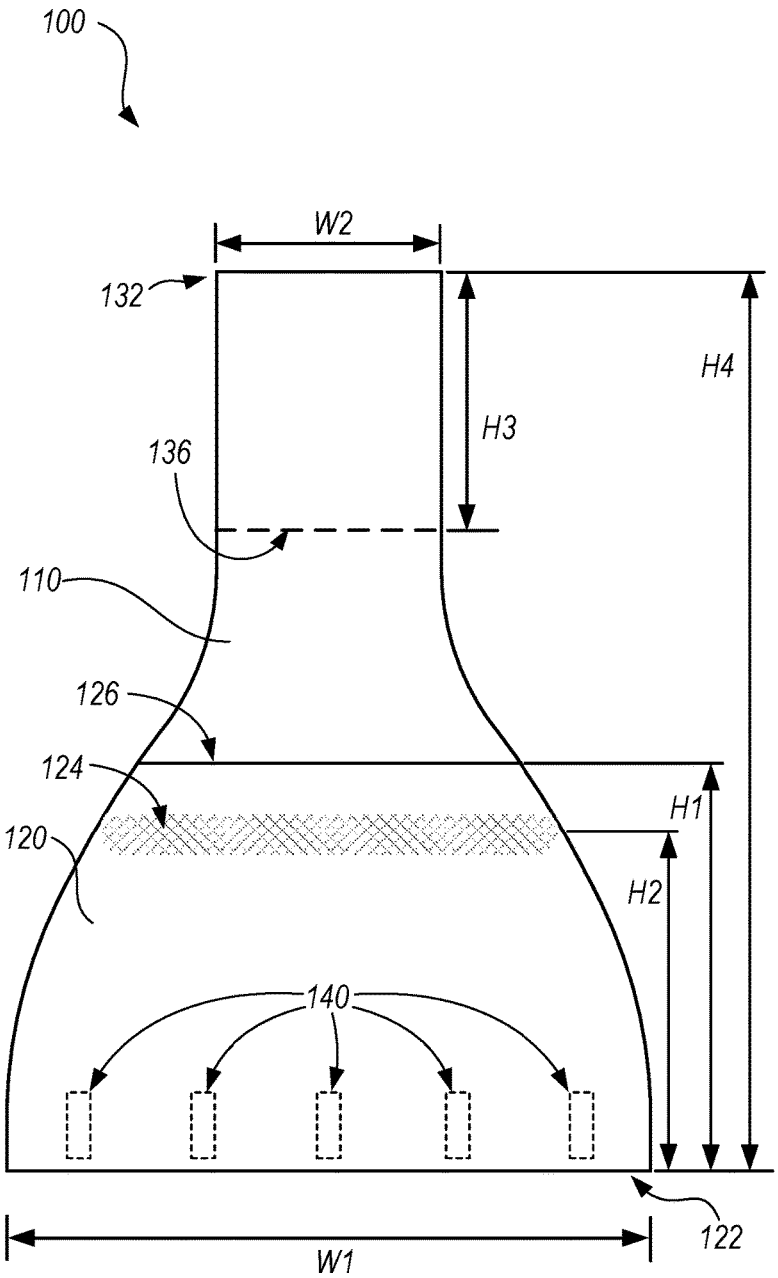
FIG. 1A is a front elevation.
Figure 1B:
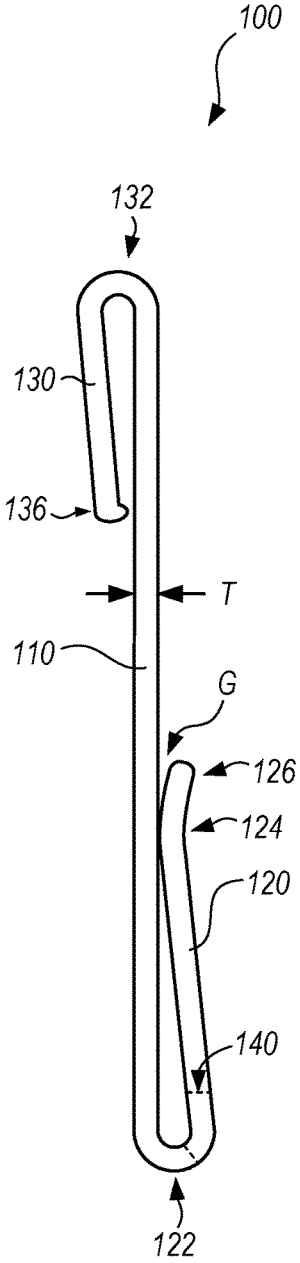
FIG. 1B is a side elevation, illustrating a drywall knife holster, in accord with embodiments.

FIGS. 1A and 1B illustrate a drywall knife holster 100; FIG. 1A is a front elevation, while FIG. 1B is a side elevation. FIGS. 1A and 1B may not be to scale; exemplary dimensions of certain features of drywall knife holster 100 are described herein and may vary according to materials used, dimensions of tools that the holster is to be used with, and the like. Upon reading and comprehending the present disclosure, one skilled in the art will readily conceive of many equivalents and variations, all of which are within the scope of this disclosure. Features of drywall knife holsters herein are also described herein using terminology such as "upward" and "downward" that are to be interpreted consistently with the orientation in which the drawings herein are presented, but do not limit embodiments to being used solely in the orientation shown.

In some embodiments, drywall knife holster 100 is fabricated from a single piece of material, such as plastic, rubber or metal, while in other embodiments, combinations of any of these materials can be used. Suitable materials will be resistant to the chemical components of typical drywall muds, and will be mechanically durable, and moderately flexible. Suitable plastics include thermoplastic acrylic-polyvinyl chloride (sometimes sold by Sikisui SPI under the brand name Kydex), certain acrylics, certain polyvinyl chlorides (PVCs), certain polyethylenes, certain polypropylenes, certain polycarbonates, certain polyamides (e.g., nylon), acrylonitrile butadiene styrene (ABS), combinations of these materials, and the like.

Holster 100 includes a back member 110 that couples, through an upwardly facing U-bend 122, with a knife holder 120. Back member 110 also couples, through a downwardly facing U-bend 132, with a belt hook 130. The downwardly facing end of belt hook 130 is considered a proximal end of the material forming holster 100, while the upwardly facing end of knife holder 120 is considered a distal end of the material.

Advantageously, U-bend 122 biases knife holder 120 toward back member 110 at a knife pinch region 124, as shown; knife holder 120 may or may not contact back member 110 at knife pinch region 124 when no drywall knife is present. Knife holder 120 ends, distal to upwardly facing U-bend 122 and knife pinch region 124, at a distal end 126 that is advantageously a slight distance from back member 110, forming a gap G. Downwardly facing U-bend 132 may bias belt hook 130 toward back member 110. Belt hook 130 may include an optional retaining feature 136 at a proximal end of the material of holster 100. Belt hook 130 and/or optional retaining feature 136 may be in contact with back member 110, or may be a slight distance from back member 110, when holster 100 is not in use. Alternatively, a proximal end of the material of holster 100 may not form retaining feature 136. The presence, absence and/or size of retaining feature 136 may involve a tradeoff between functionality and comfort. That is, when retaining feature 136 is present, drywall knife holster 100 may couple more securely with a belt or pocket of a drywaller. However, when retaining feature 136 is present and especially if it is large, it may cause belt hook 130 to press against and irritate the drywaller, as compared with drywall knife holster 100 without retaining feature 136. Thus, if present, retaining feature is ideally smaller than a thickness of a belt that it is intended for use with.

Knife holder 120 may form one or more apertures 140 near upwardly facing U-bend 122, as shown in FIGS. 1A and 1B. Apertures 140 may be of any shape and/or size, but apertures 140 that occupy a large portion of a width W1 of holster 100 at U-bend 122 may undesirably degrade a retaining force exerted on a drywall knife by knife holder 120, as discussed below. Apertures 140, and open ends of holster 100 at U-bend 122, allow at least some mud that may have stuck to a drywall knife, to exit the bottom of holster 100. Apertures 140 are typically formed within knife holder 120 near U-bend 122, rather than at a bottommost extent of U-bend 122 or within back member 110, so that the mud scatters away from a drywaller's clothing. Apertures 140 may be preferable for jobs in construction sites, where minor scattering of mud will not be an issue. For jobs in finished areas (e.g., repairs), embodiments of holster 100 that do not feature apertures 140 (and/or have sealed ends, see FIGS. 5A, 5B) may be preferable.

Figure 2A:
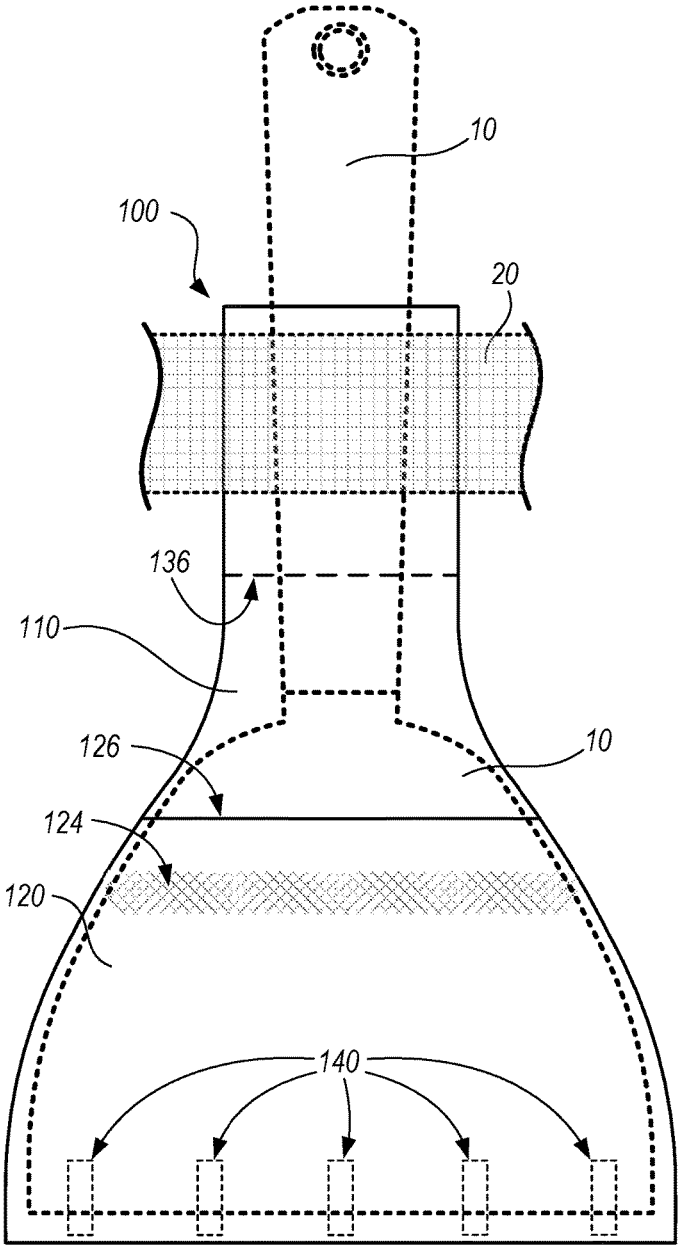
FIG. 2A is a front elevation.
Figure 2B:
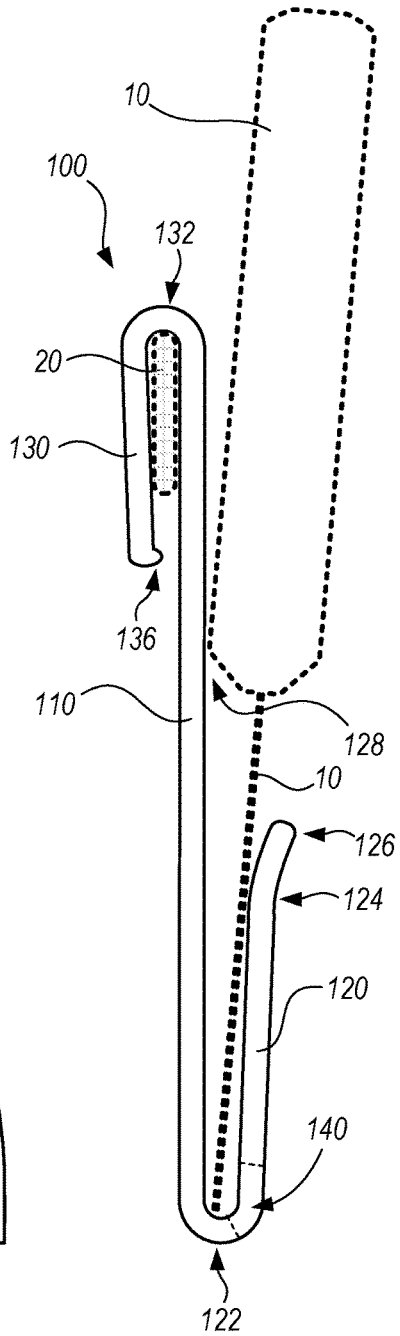
FIG. 2B is a side elevation, illustrating a drywall knife seated within the drywall knife holster of FIGS. 1A and 1B, coupled with a drywaller's belt.

In use, a drywaller inserts belt hook 130 over a belt or within a pants pocket, and slides a drywall knife blade between knife holder 120 and back member 110 so that a leading edge of the drywall knife blade seats within upwardly facing U-bend 122 (see FIGS. 2A, 2B). A drywaller that uses holster 100 quickly becomes familiar with its position relative to his or her body. The drywaller readily adapts to inserting a leading corner or edge of a drywall knife into gap G, whereupon it can be inserted fully into holster 100 until it is stopped by the leading edge reaching U-bend 122. Similarly, the drywaller readily learns where a handle of the drywall knife is, and can retrieve it easily for use. These motions become so routine that after a few hours of use, the drywaller rarely needs to divert his or her eyes from other tasks to place the knife into, or retrieve it from, holster 100.

Certain dimensions of drywall knife holster 100 are discussed below. The dimensions discussed are exemplary only; many equivalents and variations will be evident to one skilled in the art, based on the teachings herein. A thickness T of material forming holster 100 (e.g., as shown in FIG. 1B) is typically ⅛ to 3/16 inch. More durable and/or costly materials may be used with a thickness T of ⅛ inch or less; a thickness T exceeding ¼ inch is likely to make holster 100 cumbersome and heavy. All portions of holster 100 (e.g., back member 110, knife holder 120 and belt hook 130) may be of a fixed thickness T, especially in cases where holster 100 is formed by cutting and bending sheet material. When other techniques such as molding or injection molding are used, thickness T may be different in different regions of holster 100. Thicker regions may promote durability, while thinner regions may decrease weight and material cost of manufacturing. Regions where increased thickness T is likely to be helpful include U-bends 122 and 132, and distal end 126.

A width W1 at upwardly facing U-bend 122 typically matches a width of a drywall knife intended for use with holster 100. Most drywallers will prefer width W1 to be the same as, or up to about one inch wider than, a drywall knife intended for use with holster 100. Holster 100 can be used with drywall knives wider than W1, but one or both corners of the drywall knife may protrude from the sides of holster 100, and may pose an injury or damage hazard.

A height H1 of knife holder 120 above U-bend 122, and a height H2 of knife pinch region 124 above U-bend 122, help determine a retaining force exerted on a drywall knife blade within holster 100, and relate to how holster 100 prevents the drywall knife from accidentally contacting nearby objects or surfaces. For a six inch drywall knife having a blade that extends about four inches from its handle, a height H1 of about 3 inches and a height H2 of about 2½ inches are suitable. It may be undesirable to have H1 less than a distance that the drywall knife extends from a handle, as the handle will run into distal end 126 before the knife edge seats within U-bend 122. An overall height H4 is also related to size of a drywall knife intended for use therewith. For a six inch drywall knife, a height H4 of about seven inches is suitable. Height H4 should at least exceed a length of the intended drywall knife blade, so that when the blade is seated within holster 100, the handle contacts back member 110 (e.g., at point 128, see FIG. 2B). However, height H4 may not and typically will not exceed a combined length of a drywall knife blade and handle combined. Excessive height H4 (e.g., beyond about eight inches for a drywall knife that is about six inches wide) tends to place the drywall knife handle lower than desired for handy retrieval of the drywall knife, and may result in accidental contact of holster 100 with objects (e.g., when the drywaller kneels). Side profile shapes of back member 110 and knife holder 120 are typically based on shape of a drywall knife intended for use with holster 100, again, to prevent the drywall knife from accidentally contacting nearby objects or surfaces.

A width W2 at downwardly facing U-bend 132 relates to the fit of holster 100 on or within a drywaller's belt or pocket. A width W2 of about 1¾ inches has been found to be useful, but a wider or narrower width W2 can be used. Similarly, height H3 below downwardly facing U-bend 132 relates to securing belt hook 130 to the drywaller's belt or pocket. A longer height H3 may improve secure coupling of holster 100 to the drywaller's belt or pocket, but may become cumbersome. A height H3 of about 2 inches has been found to be suitable, but a longer or shorter height H3 can be used.

FIGS. 2A and 2B illustrate drywall knife holster 100 coupled with a drywaller's belt 20, and with a drywall knife 10 seated therein. FIG. 2A is a front elevation that illustrates drywall knife 10 and a portion of belt 20, while FIG. 2B is a side elevation that illustrates cross sections of drywall knife 10 and belt 20. FIGS. 2A and 2B may not be to scale. In use, drywall knife holster hangs from belt 20, secured by belt hook 130 (and/or optional retaining feature 136) as shown. The blade of drywall knife 10 rests within U-bend 122. Drywall knife 10 contacts knife holder 120 at pinch region 124, thus deforming knife holder 120 outwardly from back member 110. Pinch region 124, in turn, exerts a force on knife 10 such that the handle of knife 10 contacts back member 110 at point 128. The force exerted by pinch region 124 and back member 110 at point 128 helps keep knife 10 secure within holster 100 so that movement of the drywaller, incidental contact of objects with knife 10, and the like do not readily dislodge knife 10.

Figure 3A:
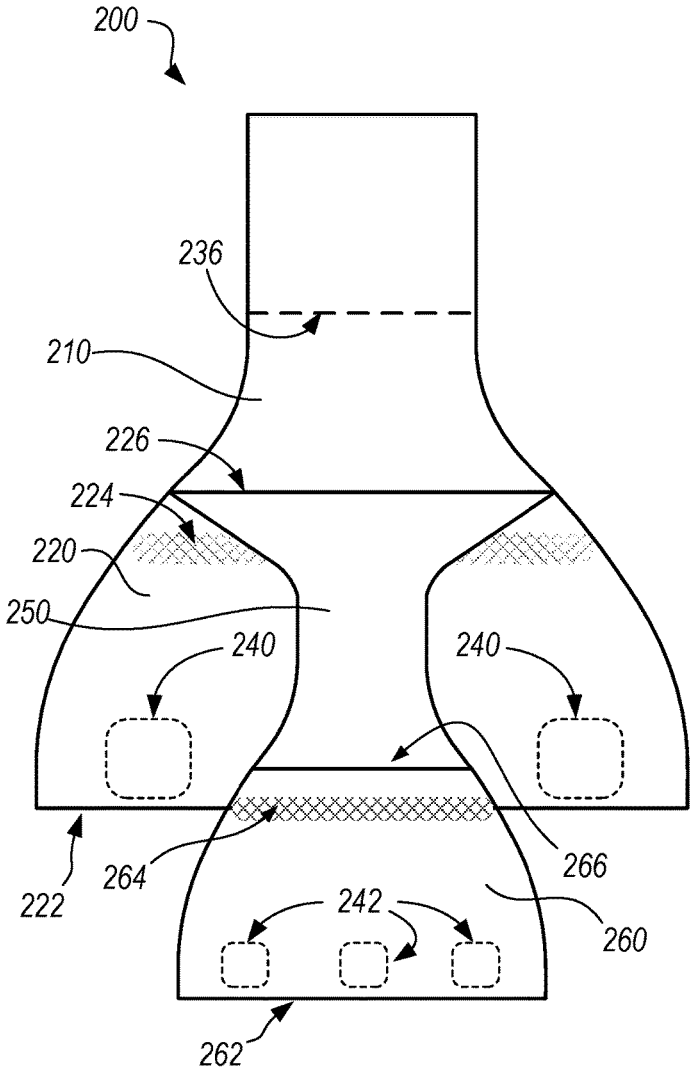
FIG. 3A is a front elevation.
Figure 3B:
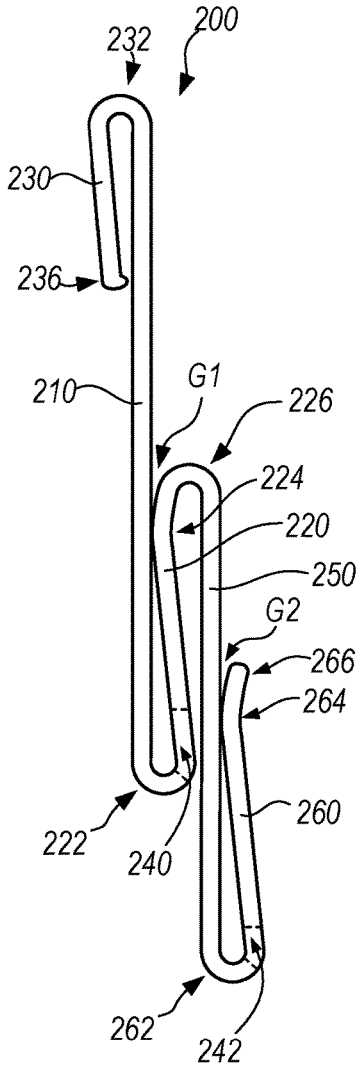
FIG. 3B is a side elevation, illustrating a drywall knife holster that can accommodate two drywall knives, in accord with embodiments.

FIGS. 3A and 3B illustrate a dual drywall knife holster 200 that can accommodate two drywall knives. FIG. 3A is a front elevation, while FIG. 3B is a side elevation. FIGS. 3A and 3B may not be to scale; exemplary dimensions of certain features of drywall knife holster 200 are described herein and may vary according to materials used, dimensions of tools that the holster is to be used with, and the like. Upon reading and comprehending the present disclosure, one skilled in the art will readily conceive of many equivalents and variations, all of which are within the scope of this disclosure.

In some embodiments, dual drywall knife holster 200 is fabricated from of plastic (possibly, a single piece of plastic) while in other embodiments, rubber or metal, or combinations of any of these materials, can be used. Holster 200 includes a back member 210 that couples, through an upwardly facing U-bend 222, with a knife holder 220. Back member 210 also couples, through a downwardly facing U-bend 232, with a belt hook 230. Advantageously, U-bend 222 biases knife holder 220 into proximity with back member 210 at a first knife pinch region 224, as shown; knife holder 220 may or may not contact back member 210 when no drywall knife is present. Knife holder 220 continues, away from upwardly facing U-bend 222 and past first knife pinch region 224, into a second downwardly facing U-bend 226 that is advantageously a slight distance from back member 210, forming a gap G1. An intermediate member 250 continues from second U-bend 226 and forms a location for holstering a second drywall knife. That is, intermediate member 250 continues into a fourth U-bend 262 and beyond to form a second knife holder 260. Second knife holder 260 forms a second knife pinch region 264, and a distal end 266 that may be separated from intermediate member 250 by a second gap G2.

In use, a first drywall knife can be seated between back member 210 and first knife pinch region 224, and a second drywall knife can be seated between intermediate member 250 and second knife pinch region 264. The principles discussed above in connection with FIGS. 1A, 1B, 2A and 2B can be used to determine dimensions for the features of holster 200 that are appropriate for drywall knives it is to be used with. Advantageously, the lower or outer of the two drywall knives (the one that will be placed with its edge within U-bend 262) will be the same size or smaller than the upper or inner of the knives (the one that will be placed with its edge within U-bend 222). This is because if the elements of holster 200 are optimized for different knife sizes, a larger knife may tend to put more stress on smaller elements if placed within U-bend 262, may tend to interfere more with access to the other knife, and may swing around awkwardly when the drywaller moves, than if the smaller knife is placed within U-bend 262. FIG. 3A illustrates dual drywall knife holster 200 with proportions that are appropriate for the upper knife being about twice as wide as the lower knife. In an alternative embodiment, a dual drywall knife holster can be made with dimensions for the upper or inner of the knives that are about the same as those of the lower or outer of the knives. FIG. 3B shows thicknesses of material in third U-bend 226, intermediate member 250, fourth U-bend 262 and second knife holder 260 being about the same as thicknesses of material in belt hook 230, back member 210 and first knife holder 220. When dual drywall knife holster 200 is formed of a single piece of sheet material, this will be the case; however, when holster 200 is made for example by molding, thicknesses of these elements can be varied as desired. Typically, when holster 200 is designed for the lower knife being a smaller knife, at least intermediate member 250, fourth U-bend 262 and second knife holder 260 will be made a bit thinner to reduce weight and material cost.

Similar to the U-bends discussed above, U-bend 232 advantageously biases belt hook 230 toward back member 210; belt hook 230 may or may not contact back member 210 when drywall knife holster 200 is not in use; belt hook 230 may include an optional retaining feature 236 that may be a slight distance from back member 210 when holster 200 is not in use; and/or, belt hook 230 can end without forming retaining feature 236.

Also, similar to apertures 140 discussed above, knife holder 220 may form one or more apertures 240 near U-bend 222, and knife holder 260 can form one or more apertures 242 near U-bend 262. Apertures 240 and/or 242 may be of any shape and/or size, recognizing the consequences of the apertures on strength of holster 200, as discussed above in connection with holster 100.

In use, a drywaller can insert belt hook 230 over a belt or within a pants pocket, slide a first drywall knife between knife holder 220 and back member 210 so that an edge of the drywall knife seats within upwardly facing U-bend 222, and slide a second drywall knife between knife holder 260 and intermediate member 250. A drywaller that uses holster 200 quickly becomes familiar with its position, and the positions of both drywall knives, relative to his or her body. The drywaller readily adapts to inserting leading corners or edges of drywall knives into gaps G1 and G2, readily learns where handles of the drywall knives are, and can retrieve them easily for use.

Figure 4A:
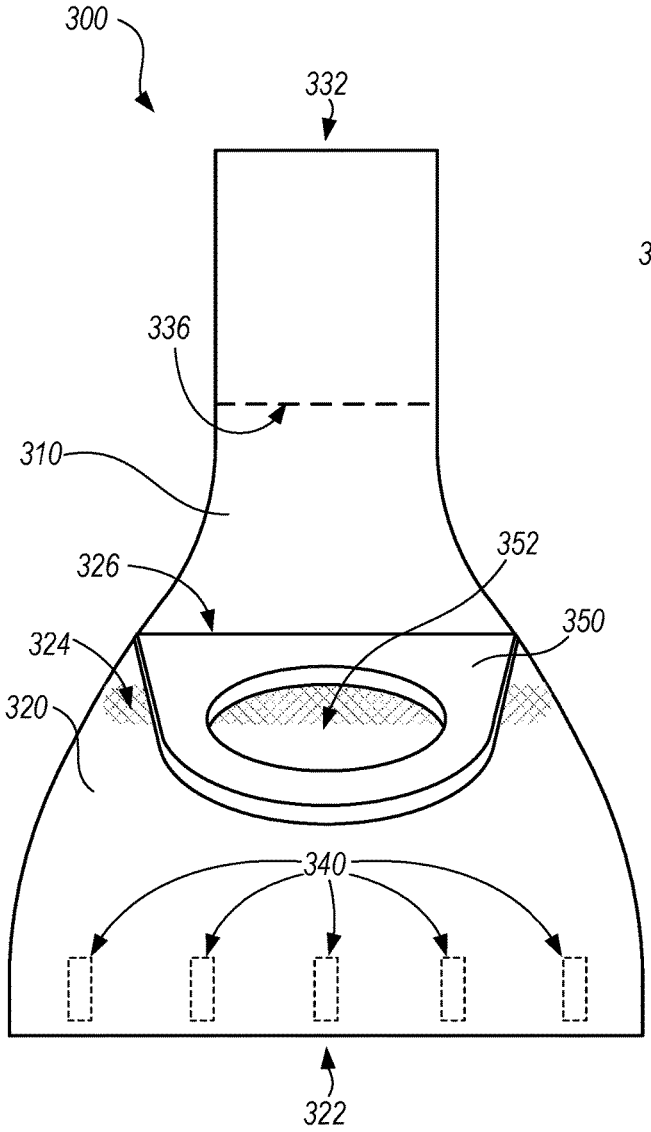
FIG. 4A is a front elevation.
Figure 4B:
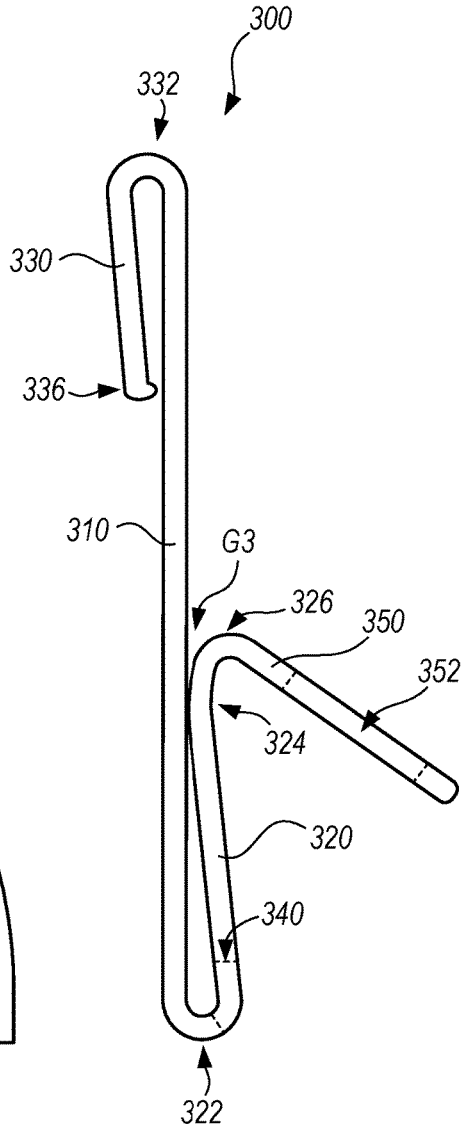
FIG. 4B is a side elevation, illustrating a drywall knife holster that can accommodate a drywall knife and another tool, in accord with embodiments.

FIGS. 4A and 4B illustrate a drywall knife holster 300 that can accommodate a drywall knife and another tool, such as but not limited to a hammer or a screwdriver. FIG. 4A is a front elevation, while FIG. 4B is a side elevation. FIGS. 4A and 4B may not be to scale; exemplary dimensions of certain features of drywall knife holster 300 are described herein and may vary according to materials used, dimensions of tools that the holster is to be used with, and the like. Upon reading and comprehending the present disclosure, one skilled in the art will readily conceive of many equivalents and variations, all of which are within the scope of this disclosure.

In some embodiments, drywall knife holster 300 is fabricated from a single piece of plastic, while in other embodiments, rubber or metal, or combinations of any of these materials, can be used. Holster 300 includes a back member 310 that couples with a knife holder 320 through an upwardly facing U-bend 322; back member 310 also couples with a belt hook 330 through a downwardly facing U-bend 332. Advantageously, U-bend 322 biases knife holder 320 into proximity with back member 310 at a first knife pinch region 324, as shown; knife holder 320 may or may not contact back member 310 when no drywall knife is present. Knife holder 320 continues, away from U-bend 322 and past first knife pinch region 324, into a bend 326 that is advantageously a slight distance from back member 310, forming a gap G3. A loop member 350 continues from bend 326 and forms an aperture 352 for retaining a further tool such as a hammer or a screwdriver. Dimensions of loop member 350 and aperture 352 may be varied as needed to accommodate various tools, and loop member 350 may form multiple apertures 352 therethrough, to accommodate multiple tools. One skilled in the art will readily conceive of many equivalents and variations, all of which are within the scope of this disclosure.

Figure 5A:
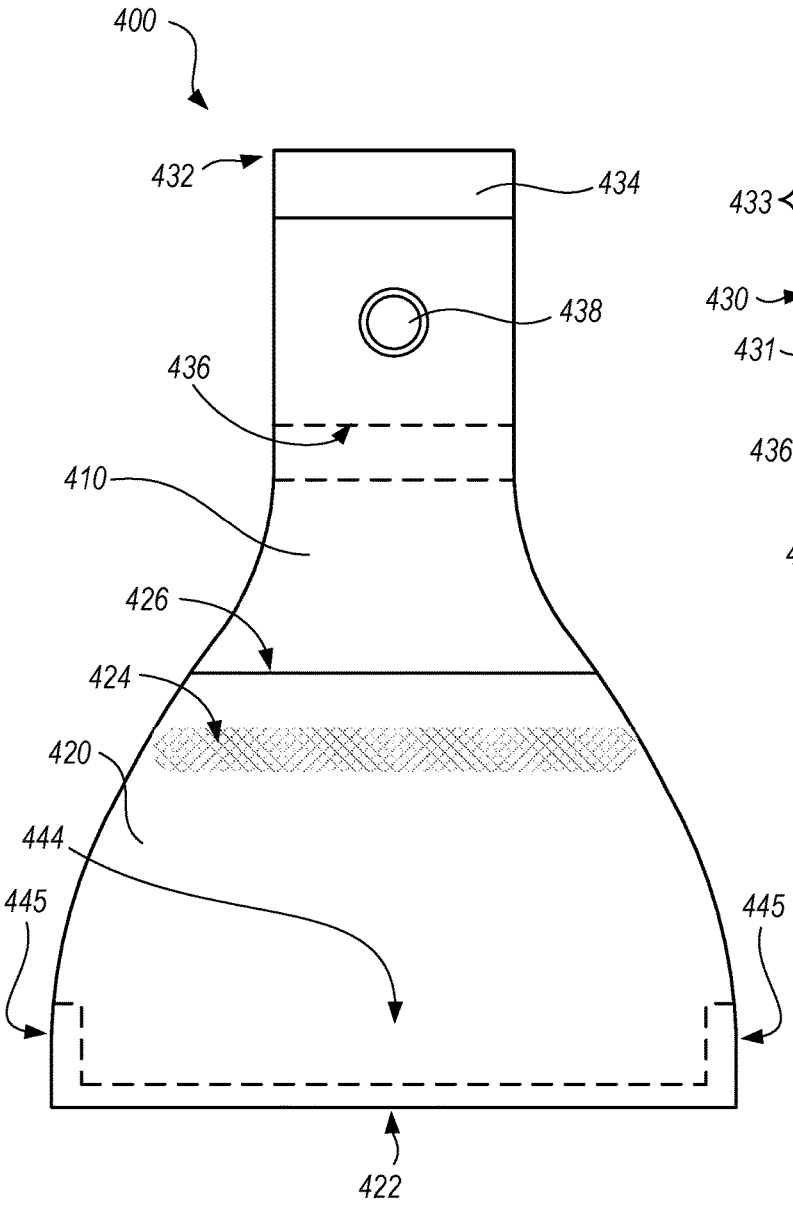
FIG. 5A is a front elevation.
Figure 5B:
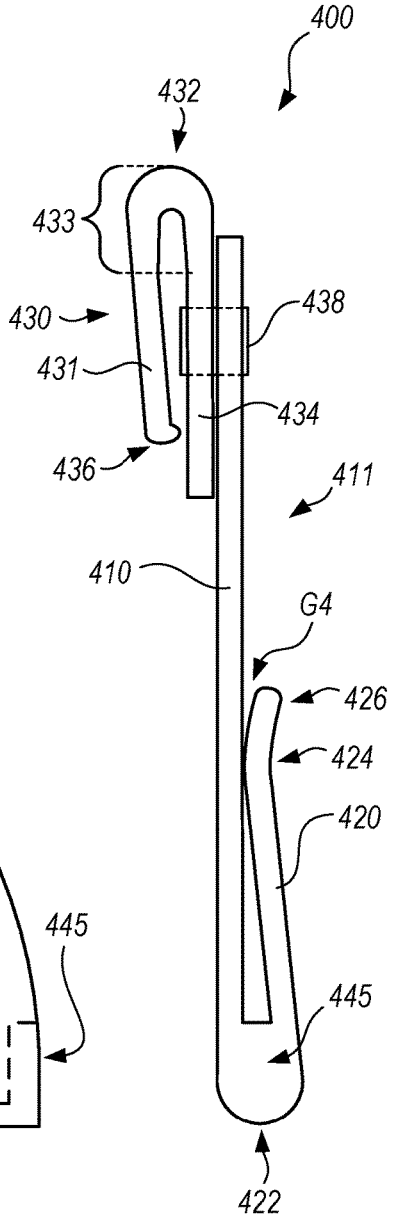
FIG. 5B is a side elevation, that illustrate exemplary features of drywall knife holsters, in accord with embodiments.

FIGS. 5A and 5B illustrate a drywall knife holster 400; FIG. 5A is a front elevation, while FIG. 5B is a side elevation. FIGS. 5A and 5B may not be to scale. Drywall knife holster 500 illustrates several features that may be used as shown, or may be adapted for use with other drywall knife holsters herein. Upon reading and comprehending the present disclosure, one skilled in the art will readily conceive of many equivalents and variations, all of which are within the scope of this disclosure.

In some embodiments, drywall knife holster 400 is fabricated of plastic, while in other embodiments, rubber or metal, or combinations of any of these materials, can be used for the multiple portions of holster 400 now described. Holster 400 includes a belt hook portion 430 that in turn includes a proximal portion 431, a downwardly facing U-bend 432 and a distal portion 434 formed of a first material. Proximal portion 431 may end in a retaining feature 436, as shown. In a region 433 of belt hook portion 430 that includes U-bend 432, the material is thicker than in other parts of belt hook portion 430. The increased thickness of region 433 may help strengthen belt hook portion 430 to increase its service life (e.g., by mitigating cracking that can occur at U-bend 432).

Belt hook portion 430 couples with a holster portion 411 through a swiveling connector 438 which may be a separate mechanical feature such as a rivet or a snap, or may be a protrusion formed by one of belt hook portion 430 or back member 410 that extends through an aperture formed in the other. Back member 410 that couples with a knife holder 420 through an upwardly facing U-bend 422.

Swiveling connector 438 is advantageously loose enough to allow holster portion 411 to swing freely in response to the weight of a drywall knife stored therein, so that when the drywaller using holster 400 leans or moves, the knife is less likely to fall out of holster 400. However, connector 438 also advantageously supplies enough resistance to rotation so that holster portion 411 does not distract the drywaller by swinging back and forth.

Because swiveling connector 438 mechanically decouples belt hook portion 430 from holster portion 411, embodiments that use swiveling connector 438 can benefit from use of differing materials for belt hook portion 430 and holster portion 411. In one particularly advantageous embodiment, belt hook portion 430 is formed of metal and includes a protrusion extending therefrom, while holster portion 411 is formed of plastic and forms an aperture that accepts the protrusion, to form swiveling connector 438.

FIGS. 5A and 5B also show back member 410 forming a semi-closed pocket 444 with knife holder 420, through sealed edge portions 445 on either side of U-bend 422, as shown (a broken line in FIG. 5A indicates an inner surface formed by edge portions 445 meeting material that forms upwardly facing U-bend 422). Pocket 444 may be advantageous for two reasons: (1) to contain drywall mud from surfaces of a drywall knife so that the mud does not scatter onto nearby surfaces, as would be desirable when work is being done in a finished area; and (2) to improve retention of a drywall knife within holster 400 by forming a barrier to a blade of the drywall knife slipping out of the sides of holster 400. It should also be noted that knife holder 420 forms no apertures, also for the purpose of containing drywall mud instead of allowing it to scatter.

Except as discussed above, features of holster 400 such as belt hook portion 430, U-bends 422 and 432, knife holder 420, knife pinch region 424, distal end 426 forming gap G4 from back member 410 have similar or identical function to similar items described above in connection with holsters 100, 200 and 300.

Although the features of increased thickness in selected regions, using a swiveling connector between a belt hook portion and a holster portion, omitting apertures in a knife holder, and forming sealed edge portions are disclosed in FIGS. 5A and 5B, they are understood as examples of strategies that may be applied to other drywall knife holsters herein. That is, the strategy demonstrated by the increased thickness of region 433 can be implemented for other portions of drywall knife holsters disclosed herein, such as but not limited to, U-bends 122, 132, 222, 232, 226, 262, 322, 332, bend 326, loop member 350, adjacent regions to these features, or any other portions of drywall knife holsters that are subject to increased mechanical stress compared to adjacent areas. A swiveling fastener between a belt hook and a back member, and/or sealed edge portions, could be used in any of holsters 100, 200 and/or 300. Upon reading and comprehending the present disclosure, one skilled in the art will readily conceive of many equivalents and variations, all of which are within the scope of this disclosure.

It should thus be clear that a variety of drywall knife holsters and features are contemplated as within the scope of the present application. Having described several embodiments, it will be recognized by those of skill in the art that various modifications, alternative constructions, and equivalents may be used without departing from the spirit of the invention. Accordingly, the above description should not be taken as limiting the scope of the invention.

What is claimed is:

1. A drywall knife holster, comprising:

a belt hook formed of a material;

a back member formed of the material, wherein the back member couples with the belt hook through a downwardly facing U-bend formed of the material; and a knife holder formed of the material, wherein:

the knife holder couples with the back member through an upwardly facing U-bend, and the upwardly facing U-bend biases a pinch region of the knife holder toward the back member, such that inserting a blade of a drywall knife between the knife holder and the back member, and seating a leading edge of the blade within the upwardly facing U-bend, causes the pinch region of the knife holder to urge a handle of the drywall knife into contact with the back member, and the material of the knife holder defines one or more apertures that extend through the knife holder, between the upwardly facing U-bend and the pinch region.

2. The drywall knife holster of claim 1, wherein the material of the knife holder that is distal to the upwardly facing U-bend curves outwardly from the back member, so that a gap exists between the material of the knife holder and the back member.

3. The drywall knife holster of claim 1, wherein the material is of a constant thickness from the downwardly facing U-bend, through the back member, through the upwardly facing U-bend, to at least the pinch region of the knife holder.

4. The drywall knife holster of claim 1, wherein the material is thicker at one or both of the downwardly facing U-bend and the upwardly facing U-bend, relative to the back member.

5. The drywall knife holster of claim 1, wherein the material forms a width of at least six inches at the upwardly facing U-bend.

6. The drywall knife holster of claim 1, wherein a width of the back member increases from a width of less than two inches at the downwardly facing U-bend to a width of at least six inches at the upwardly facing U-bend.

7. A drywall knife holster, comprising:

a belt hook portion formed of a first material; and a holster portion formed of a second material, the holster portion including:

a back member formed of the second material, and a knife holder formed of the second material, wherein:

the knife holder couples with the back member through an upwardly facing U-bend, the upwardly facing U-bend biases a pinch region of the knife holder toward the back member, such that inserting a blade of a drywall knife between the knife holder and the back member, and seating a leading edge of the blade within the upwardly facing U-bend, causes the pinch region of the knife holder to urge a handle of the drywall knife into contact with the back member, and the material of the knife holder defines one or more apertures that extend through the knife holder, between the upwardly facing U-bend and the pinch region;

and wherein the holster portion couples with the belt hook portion through a swiveling connector.

8. The drywall knife holster of claim 7, wherein the first material and the second material are the same material.

9. The drywall knife holster of claim 7, wherein the first material and the second material are different materials from one another.

10. The drywall knife holster of claim 7, wherein the second material of the knife holder that is distal to the upwardly facing U-bend curves outwardly from the back member, so that a gap exists between the second material of the knife holder and the back member.

11. The drywall knife holster of claim 7, wherein the second material is of a constant thickness from the back member, through the upwardly facing U-bend, to at least the pinch region of the knife holder.

12. A drywall knife holster, comprising:

a belt hook formed of a material;

a back member formed of a first continuation of the material, wherein the back member couples with the belt hook through a first downwardly facing U-bend of the material;

a first knife holder formed of a second continuation of the material, wherein the first knife holder couples with the back member through a first upwardly facing U-bend of the material, and the first upwardly facing U-bend biases a first pinch region of the first knife holder toward the back member, such that inserting a blade of a drywall knife between the first knife holder and the back member, and seating a leading edge of the blade within the first upwardly facing U-bend, causes the first pinch region of the first knife holder to urge a handle of the drywall knife into contact with the back member; and a third continuation of the material, distal to the first knife holder, wherein the third continuation of the material forms:

a second downwardly facing U-bend;

an intermediate member; and a second knife holder, wherein the second knife holder couples with the intermediate member through a second upwardly facing U-bend, and the second upwardly facing U-bend biases a second pinch region of the second knife holder toward the intermediate member;

such that inserting a blade of a second drywall knife between the second knife holder and the intermediate member, and seating a leading edge of the blade of the second drywall knife within the second upwardly facing U-bend, causes the second pinch region of the second knife holder to urge a handle of the second drywall knife into contact with the intermediate member.

13. The drywall knife holster of claim 12, wherein the material is of a constant thickness from the belt hook, through the first downwardly facing U-bend, through the back member, through the first upwardly facing U-bend, through the first knife holder, through the second downwardly facing U-bend, through the intermediate member, through the second upwardly facing U-bend and through the second knife holder.

14. The drywall knife holster of claim 12, wherein:

the back member is between five and eight inches in height between the first downwardly facing U-bend and the first upwardly facing U-bend.

15. The drywall knife holster of claim 12, wherein the back member forms a width of at least six inches at the first upwardly facing U-bend.

16. The drywall knife holster of claim 12, wherein a width of the back member increases from a width of less than two inches at the first downwardly facing U-bend to a width of at least six inches at the first upwardly facing U-bend.

17. The drywall knife holster of claim 12, wherein:

the material is of a first thickness from the belt hook, through the first downwardly facing U-bend, the back member, the first upwardly facing U-bend, and the first knife holder; and the material is of a second thickness that is less than the first thickness, in one or more of the intermediate member, the second upwardly facing U-bend and the second knife holder.

18. The drywall knife holster of claim 12, wherein the material of the first knife holder defines:

one or more first apertures that extend through the first knife holder, between the first upwardly facing U-bend and the first pinch region, and one or more second apertures that extend through the second knife holder, between the second upwardly facing U-bend and the second pinch region.

* * * * *